US009323279B2

(12) United States Patent
Moehling et al.

(10) Patent No.: US 9,323,279 B2
(45) Date of Patent: Apr. 26, 2016

(54) ADJUSTABLE GRIP HAND REST

(71) Applicant: Otto Engineering, Inc., Carpentersville, IL (US)

(72) Inventors: Steven Moehling, Crystal Lake, IL (US); Douglas Fischer, Addison, IL (US)

(73) Assignee: OTTO ENGINEERING, INC., Carpentersville, IL (US)

( * ) Notice: Subject to any disclaimer, the term of this patent is extended or adjusted under 35 U.S.C. 154(b) by 0 days.

(21) Appl. No.: 14/490,113

(22) Filed: Sep. 18, 2014

(65) Prior Publication Data

US 2016/0085257 A1 Mar. 24, 2016

(51) Int. Cl.
*G05G 1/06* (2006.01)
*G05G 9/00* (2006.01)

(52) U.S. Cl.
CPC ... *G05G 1/06* (2013.01); *G05G 9/00* (2013.01)

(58) Field of Classification Search
CPC ..... G05G 1/06; G05G 9/047; G05G 1/58; E02F 9/2004; Y10T 74/20201; Y10T 16/44; Y10T 74/20732
See application file for complete search history.

(56) References Cited

U.S. PATENT DOCUMENTS 6,691,589 B2 * 2/2004 Gillman ..... G05G 1/10 248/118.3
7,886,632 B2 * 2/2011 Stoffers ..... E02F 9/2004 248/118.3
2010/0205813 A1 * 8/2010 Plaze ..... A63B 29/08 30/308.1

OTHER PUBLICATIONS

APEM product brochure, no date, believed to be prior art, 6 pages.
Gessmann product brochure, Palm grip B 3, dated 2013, 1 page.
Gessmann product brochure, Palm grip B 20, dated 2013, 1 page.
DeltaTech controls product brochure, MFG Multifunction Grips, pages from http://www.deltatechcontrols.com, dated 2010, 16 pages.
Promax Alloy Quick Release Seat Clamp description and specifications, pages from http://www.sears.com/promax-alloy-quick-release-seat-clamp/p-00685989000P, dated Oct. 21, 2010, 3 pages.
Penny + Giles Introduces New Multifunctional Handle for Rugged Joystick Controllers, article, dated Jul. 24, 2012, pages from http://www.pennyandgiles.com/Newsroom/News/Penny-Giles-Introduces-New-Multifunctional-Handle.aspx, 1 page.
Danfoss, Joysticks, product sheet, pages from http://powersolutions.danfoss.com/products/electronic-components/Joysticks/#, printed from the Internet on Sep. 18, 2014, 3 pages.
(Continued)

*Primary Examiner* — Thomas Diaz
(74) *Attorney, Agent, or Firm* — McAndrews, Held & Malloy, Ltd.

(57) ABSTRACT

A hand grip for use in controlling machinery. The grip includes a grip body and a hand rest connected to the grip body. The hand rest adjustably slides and rotates with respect the grip body grip. The hand rest includes a first locking part that is configured to engage the grip body to lock the hand rest in a locked position with respect to the grip body such that the hand rest does not slide with respect to the grip body and configured to disengage from the grip body such that the hand rest slidably moves with respect to the grip body. The hand rest includes a second locking part that, when unlocked, allows the hand rest to rotate with respect to the grip body, and that, when locked, prevents the hand rest from rotating with respect to the grip body.

16 Claims, 11 Drawing Sheets

(56) References Cited

OTHER PUBLICATIONS

Engcon Group, MIG2 makes work easier, product sheet, page from http://engcon.com/sweden/en/engcon-sweden/information/press-releases/press-release.html?articleId=4.1a2820a61485a60d706211, printed from the Internet on Oct. 22, 2014, 1 page.
Engcon Group's press room, list of press releases, including article "MIG2 makes work easier," dated Sep. 15, 2014; webpage from http://engcon.com/sweden/en/engcon-sweden/press.html, printed from the Internet on Oct. 22, 2014, 2 pages.
SVAB Precision Control Systems, SVAB Hand-Rest L8, product information, no date, 2 pages.
SVAB Precision Control Systems, article "Hand-Rest and Digging Brake on MaskinExpo," dated May 23, 2014, from webpage from http://svab.se/en/aktuellt/handstod-och-gravbroms-pa-maskinexpo/, printed from the Internet on Oct. 22, 2014, 1 page.
SVAB Precision Control Systems, Hand-Rest L8, product sheet, refers to Product Information SVAB Hand-Rest L8 B-EN, dated Aug. 15, 2014, from webpage from http://svab.se/en/produkter/styr-reglage/handstod-l8/, printed from the Internet on Oct. 22, 2014, 1 page.

* cited by examiner

ADJUSTABLE GRIP HAND REST

BACKGROUND

User-operated heavy equipment, such as that found in construction, farming, industry, and the military, typically includes at least one control grip that is used by the operator to move and control the equipment. The grip operates similarly to a joy stick but is larger, and the operator uses one of his hands to move the grip and press buttons and switches on the grip in order to control the equipment. Often, the operator has to have his hand on the grip for long periods of time while using the grip to control the equipment. Therefore, some grips include rests or supports upon which the operator can rest his hand while still also keeping his hand on the grip.

One type of conventional grip rest is formed integrally with the grip near the bottom of the grip and is stationary with respect to the grip. The rest is a portion that flares out generally perpendicularly from the grip and may be contoured to receive the bottom portion of a hand. Such "one size fits all" rests, however, do not accommodate all operator hand sizes and shapes. For example, depending on the size of an operator's hands, such rests may be positioned too low along the body of the grip for the operator's hand to be able to engage all of the buttons positioned near the top of the grip while still lying on top of the rest. In such a case, the rest does not provide any support to the user's hand while the user's hand is operating the grip. Therefore, the user has to move his hand between the rest and the buttons on the grip during operation, which can lead to fatigue, reduced productivity, and/or injury.

There are also conventional adjustable grip rests that can be moved with respect to the body of the grip. Such adjustable grip rests, however, require multiple hands, special equipment, and even multiple operators to adjust the rests. Therefore, such rests cannot quickly or easily be adjusted by one operator and require work stoppages so that the operator(s) can adjust the position of the grip rest. Because so much effort is involved in adjusting the rests, new users may not take the time to adjust the rests from the position they were set at by a previous user or only a specific individual may be allowed to operate the grip so that time is not spent on adjusting the hand rest for a different user.

SUMMARY OF EMBODIMENTS OF THE INVENTION

Certain embodiments of the present invention provide a hand grip including a grip body and a hand rest connected to the grip body. The hand rest is configured to slide and rotate with respect to the grip body. The hand rest includes a first locking part that is configured to engage the grip body to lock the hand rest in a locked position with respect to the grip body such that the hand rest does not slide with respect to the grip body. The first locking part is also configured to disengage from the grip body such that the hand rest can slidably move with respect to the grip body. The hand rest includes a second locking part that, when unlocked, allows the hand rest to rotate with respect to the grip body, and that, when locked, prevents the hand rest from rotating with respect to the grip body.

The grip body can also include a first set of teeth and the first locking part of the hand rest can include a second set of teeth, wherein the second set of teeth engages the first set of teeth to lock the hand rest in the locked position. The grip body can also include a channel and a slot therein, and the hand rest can include a base portion that has the first locking part and that is configured to slide within the channel. The base portion is connected to the grip body by a shaft that extends through the slot in the channel, and the base portion slides along the shaft.

The hand rest can include a rotating support arm and a base portion, and the second locking part of the hand rest can include a first set of teeth located on the support arm and a second set of teeth located on the base portion. The first and second sets of teeth engage each other to prevent the support arm from rotating with respect to the base portion.

The hand rest can also include a cam arm that rotates with respect to the support arm and the base portion. The cam arm rotates to engage the support arm such that the support arm moves laterally toward the base portion and the first set of teeth on the support arm engages the second set of teeth on the base portion.

Certain embodiments of the present invention provide a grip for use in controlling machinery. The grip includes a hand grip having a grip body and a hand rest connected to the grip body. The hand rest is configured to slide with respect to the grip body and rotate with respect to the grip body. The hand rest includes a base portion connected to the grip body by a shaft, a support arm rotatably connected to the base portion, and a cam arm rotatably connected to the support arm. The cam arm is rotatable to (1) a first position in which the cam arm engages the support arm to lock the support arm in a first locked position with respect to the base portion and lock the base portion in a second locked position with respect to the grip body and (2) a second position in which the cam arm disengages from the support arm such that the support arm can rotate with respect to the base portion and the base portion can move along the shaft with respect to the grip body.

Certain embodiments of the present invention provide a grip for use in controlling machinery. The grip includes a hand grip having a grip body that includes a slot extending along a side thereof and a first set of teeth positioned proximate the slot. The grip includes a hand rest connected to the grip body. The hand rest includes a shaft, a base portion slidably connected to the shaft, a support arm rotatably connected to the base portion, and a cam arm rotatably connected to the support arm. The shaft extends from the base portion through the slot of the grip body and connects the base portion to the grip body. The base portion is slidably moveable along the shaft with respect to the grip body and the shaft is slidably moveable within the slot. The base portion further includes a second set of teeth and a third set of teeth and the support arm includes a fourth set of teeth. When the cam arm is rotated toward a locking position, the cam arm pushes the support arm laterally such that (1) the fourth set of teeth of the support arm engages the third the of teeth of the base portion to prevent rotation by the support arm with respect to the base portion and (2) the support arm pushes the base portion laterally along the shaft such that the second set of teeth of the base portion engages the first set of teeth of the grip body to prevent movement of the shaft along the slot of the grip body.

Figure 1:
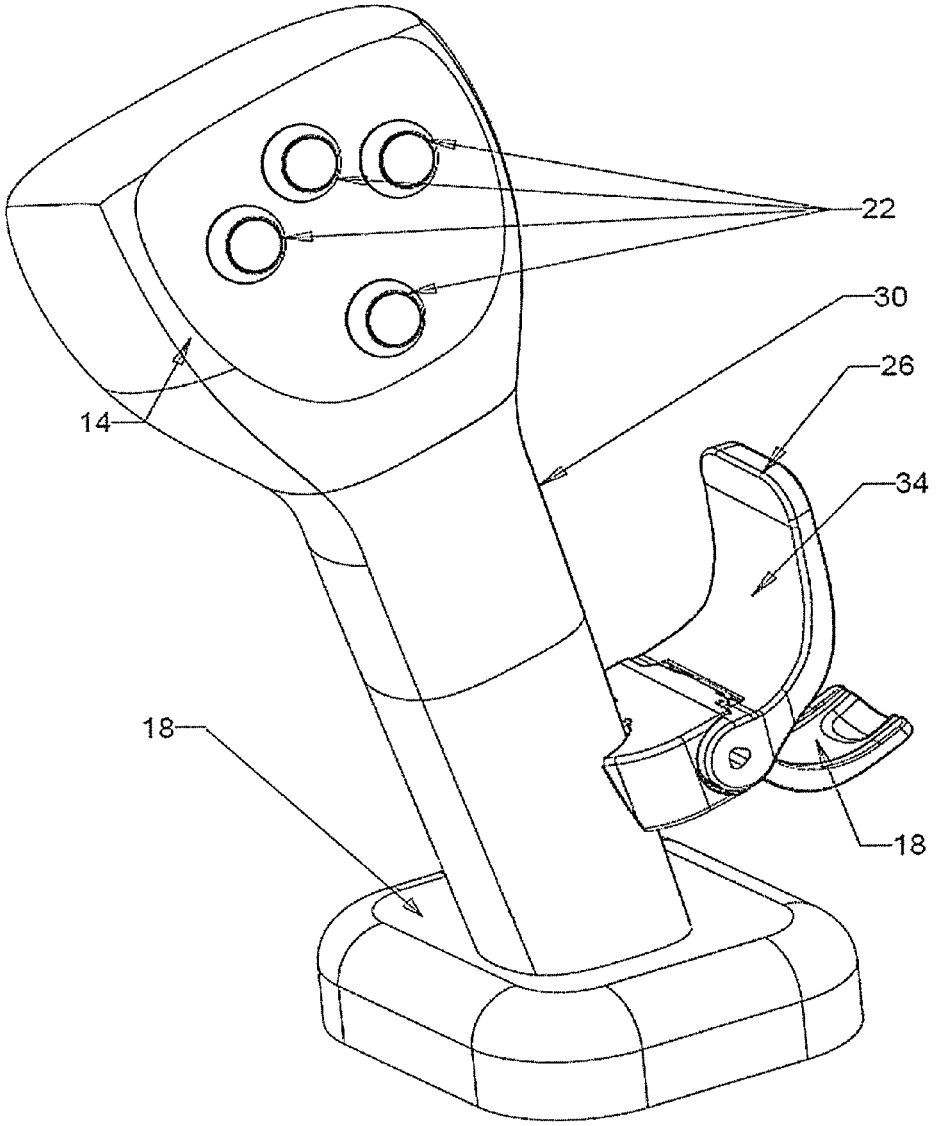
FIG. 1 illustrates an isometric view of a grip control in accordance with an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Referring to the drawings, FIG. 1 illustrates an isometric view of a grip control 10 in accordance with an embodiment of the present invention. The grip control 10 can be used to operate a variety of vehicles, machines, and equipment. For example, the grip control 10 can be used by an operator to control farming, construction, and mining equipment. The grip control 10 is similar to a joystick and includes a grip or grip body 14 connected to a base portion 18. The grip 14 can be moved with respect to the base portion 18. The grip 14 includes buttons, switches, and other controls 22 located near the top of the grip 14 that control the operation of the equipment. An operator places his hand on the grip 14 and can use his hand to move the grip 14 to control movement of the equipment. The user can also use his thumb to engage the buttons 22 at the top of the grip 14. The grip 14 shown in FIG. 1 is shaped to be operated by the right hand of an operator. However, the grip 14 can be configured to be operated by an operator's left hand or by either hand of an operator.

The grip 14 includes an adjustable hand rest or hand support 26. The rest 26 is connected to a side 30 of the grip 14. The rest 26 includes a support arm or support portion 34 and a locking lever 38. When an operator places his hand on the grip 14, the operator can rest the bottom and side of his hand on the hand rest 26 and support portion 34.

Figure 2:
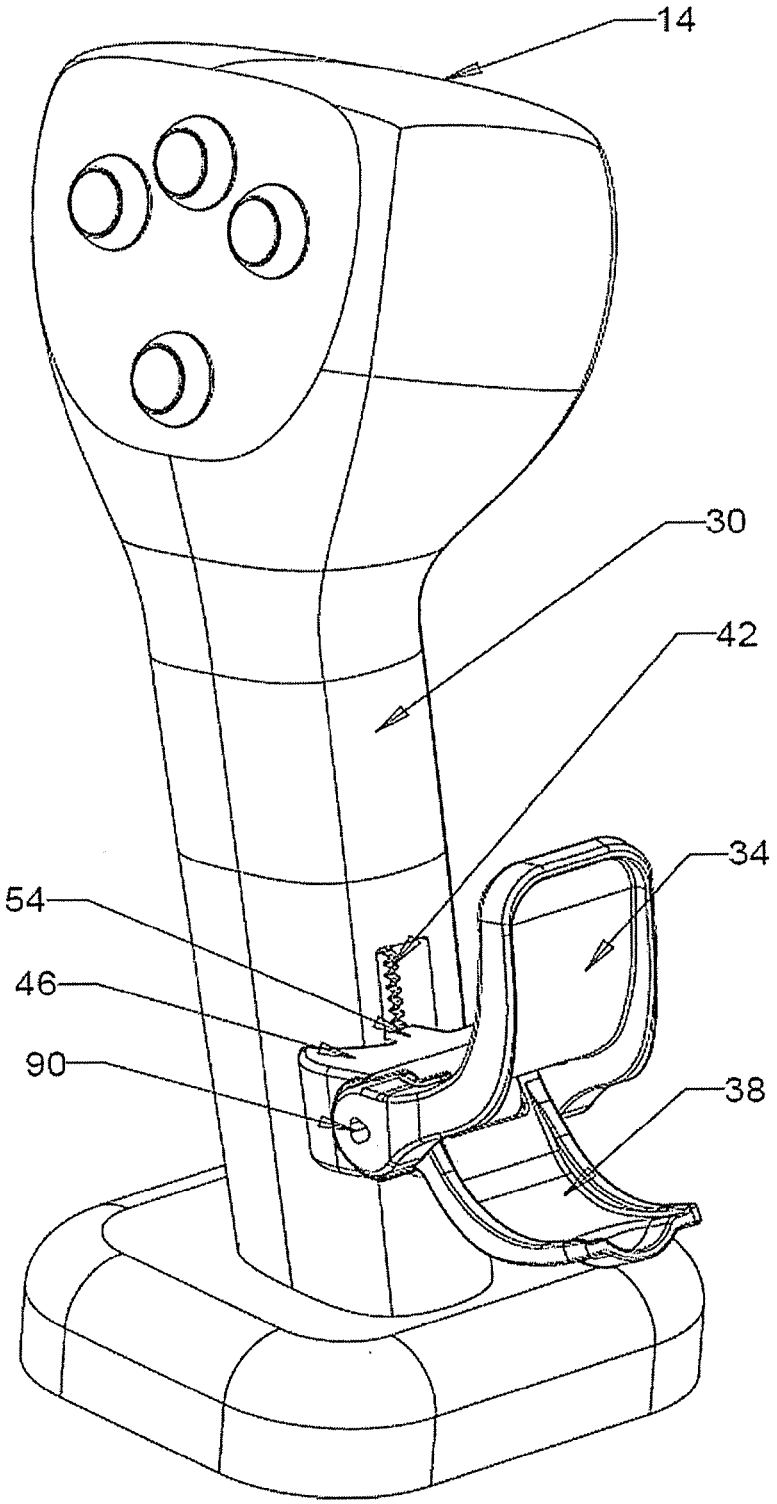
FIG. 2 illustrates a rear isometric view of the grip of FIG. 1.

FIG. 2 illustrates a rear isometric view of the grip 14 of FIG. 1. The grip 14 includes a channel 42 along a lower portion of the side 30 of the grip 14. The grip 14 includes locking teeth 50 in the channel 42. The hand rest 26 includes a base portion or locking block 46 on which the support arm 34 and locking lever 38 are mounted. The locking block 46 includes a center portion 54 that extends into the channel 42 and is configured to move up and down within the channel 42. As the center portion 54 of the locking block 46 moves up and down in the channel 42, the support arm 34 and locking lever 38 also move up and down along the side 30 of the grip 14. By moving the hand rest 26 up and down the channel 42 of the grip 14, an operator can adjust the height of the hand rest 26 to a position where the operator can reach the buttons 22 on the grip 14 with his thumb and/or fingers while resting the bottom of his hand on the hand rest 26. The operator can rest the bottom of his hand on the hand rest 26 and the locking block 46. He can rest the back of his hand on the hand rest 26, which helps in operation of the joystick/grip 14.

Figure 3:
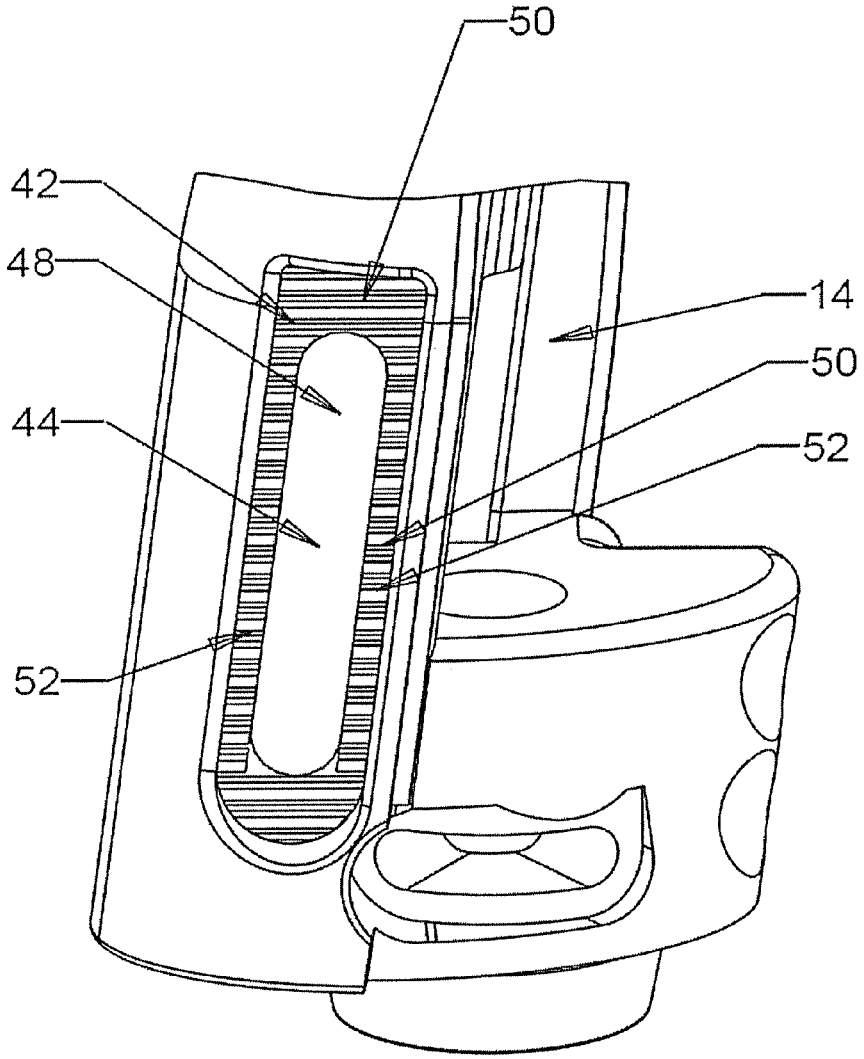
FIG. 3 illustrates a partial rear view of a version of the grip of FIG. 1.

FIG. 3 illustrates a partial rear view of the grip 14 of FIG. 1 with the hand rest 26 (FIG. 2) removed. The channel 42 of the grip 14 includes a vertical slot 44 located between two rows 52 of the teeth 50. The slot 44 leads into a cavity 48 in the interior of the grip 14.

Figure 4:
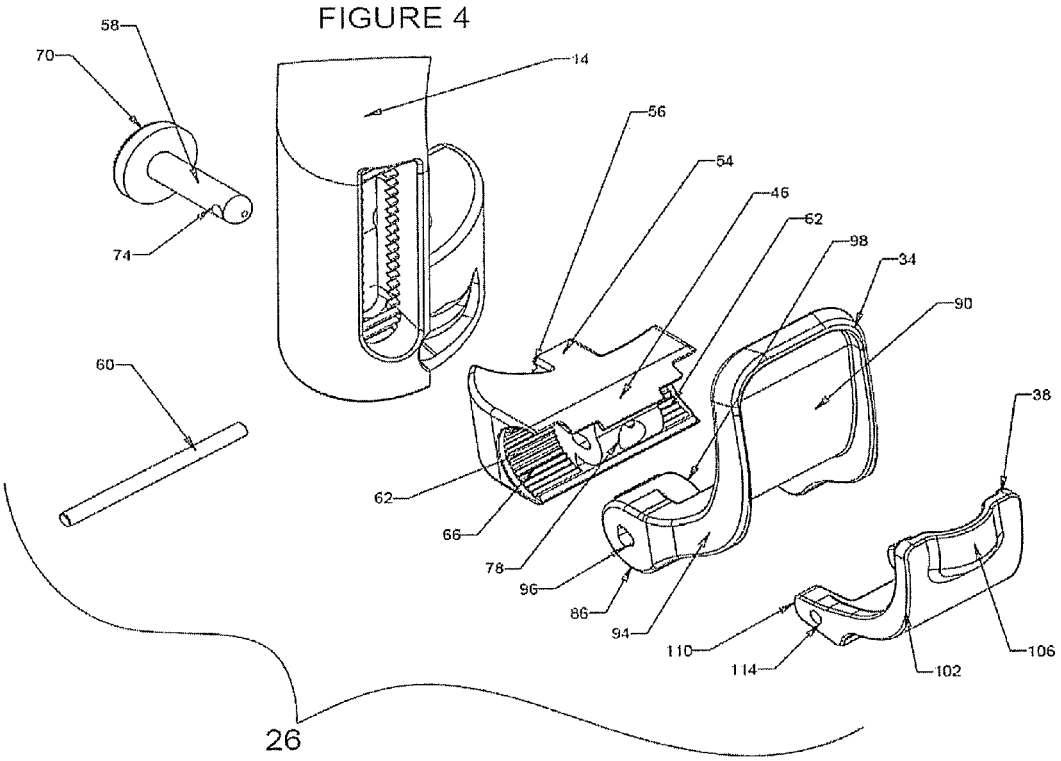
FIG. 4 illustrates a partial isometric view of a version of the grip of FIG. 1 with the hand rest shown in an exploded view.
Figure 5:
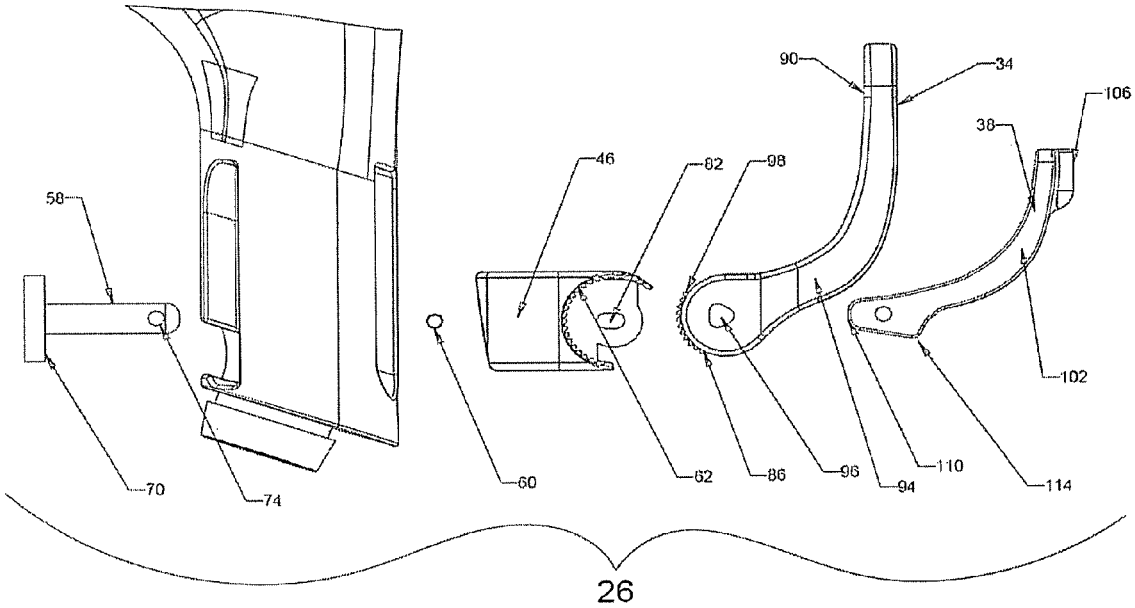
FIG. 5 illustrates a side view of FIG. 4.

FIG. 4 illustrates a partial isometric view of the grip 14 of FIG. 1 with the hand rest 26 shown in an exploded view, and FIG. 5 illustrates a side view of FIG. 4. As shown in FIGS. 4 and 5, the hand rest 26 includes a locking shaft 58 and pin 60 in addition to the support arm 34, the locking lever 38, and the locking block 46. The locking shaft 58 includes a head 70 at one end and includes a hole 74 near an end opposite the head 70. The locking block 46 includes rounded cutouts 62 on opposite sides thereof with locking teeth 66 extending outward along the cutouts 62. The locking block 46 also includes a bore 78 that is sized to slidably receive the locking shaft 58. The locking block 46 further includes an oval hole 82 that is perpendicular to the bore 78. The locking block 46 includes teeth 56 along the front side of the center portion 54.

The support arm 34 includes a generally vertical plate portion 90 from which extends a pair of curved arms 94. At the end of each arm 94 is a cylindrical base portion 86. Each base portion 86 includes a hole 96. The cylindrical base portions 86 include teeth 98 extending outwardly therefrom. The rounded cutouts 62 of the locking block 46 are configured to receive the base portions 86 of the support arm 34 such that the base portions 86 have room to rotate and move laterally within the cutouts 62. In addition, the teeth 98 of the base portions 86 are configured to engage and interlock with the teeth 66 in the cutouts 62 of the locking block 46. The base portions 86 are positioned in the cutouts 62 such that the holes 96 of the base portions 86 are aligned with the hole 82 of the locking block 46.

The locking lever 38 includes a generally curved body 102 with an indented portion 106 at one end and two cam arms 110 at another end. The indented portion 106 is configured to be engaged by a user's finger or thumb. Each cam arm 110 includes a hole 114. The body 102 of the locking lever 38 is narrower than the support arm 34 and the cam arms 110 of the locking lever 38 can be received in cutouts 118 (FIG. 7) on the inner sides of the base portions 86 of the support arm 34.

Figure 6:
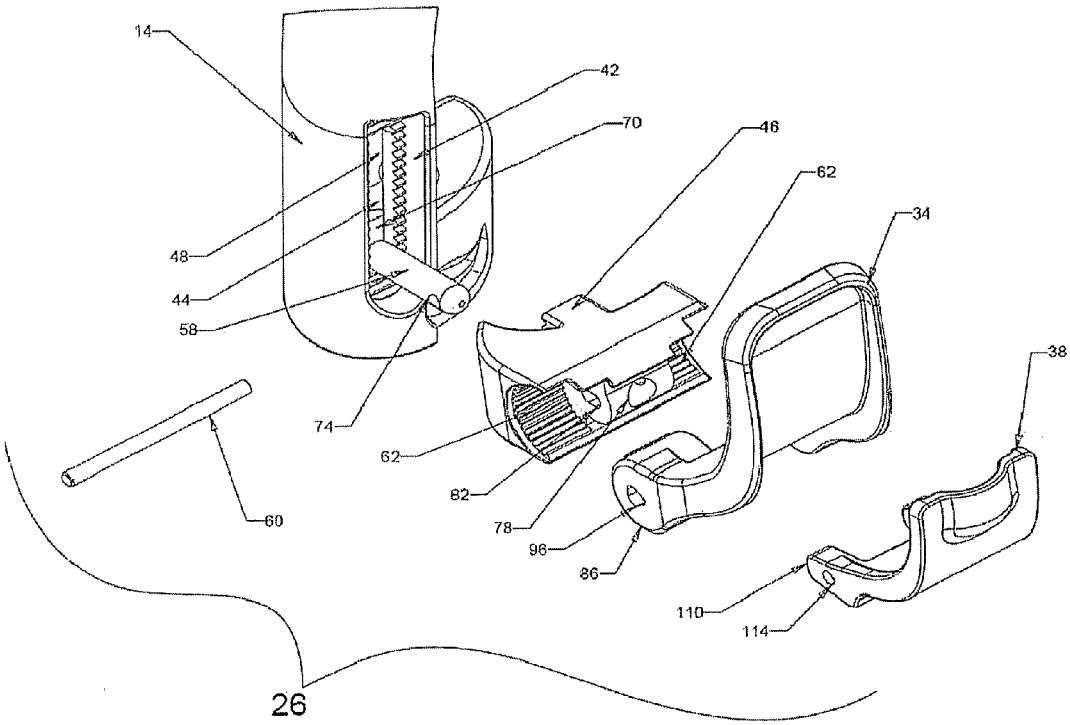
FIG. 6 illustrates a partial isometric view of a version of the grip of FIG. 1 with the hand rest shown in an exploded view.

FIG. 6 illustrates a partial isometric view of the grip 14 of FIG. 1 with the hand rest 26 shown in an exploded view. FIG. 6 differs from FIG. 4 by showing the head 70 of the locking shaft 58 positioned in the cavity 48 of the grip body 14 with the locking shaft 58 extending out of the grip body 14 through the slot 44. The hand rest 26 is assembled to be connected to the grip 14 by sliding the bore 78 of the locking block 46 along the locking shaft 58 until the center portion 46 enters the channel 42 and the hole 82 of the locking block 46 is aligned with the hole 74 of the locking shaft 58. The base portions 86 of the support arm 34 are then positioned in the cutouts 62 of the locking block 46 until the holes 96 of the base portions 86 are aligned with the hole 82 of the locking block 46 and the hole 74 of the locking shaft 58.

The cam arms 110 of the locking lever 38 are then positioned in the cutouts 118 (FIG. 7) on the inner sides of the base portions 86 until the holes 114 in the cam arms 110 are aligned with the holes 96 of the base portions 86, the hole 82 of the locking block 46, and the hole 74 of the locking shaft 58. Once the holes 114, 96, 82, and 74 are aligned, the pin 60 is inserted into the holes 114, 96, 82, and 74 to secure the locking shaft 58, locking block 46, support arm 34, and locking lever 38 to each other and to the grip body 14.

Figure 7:
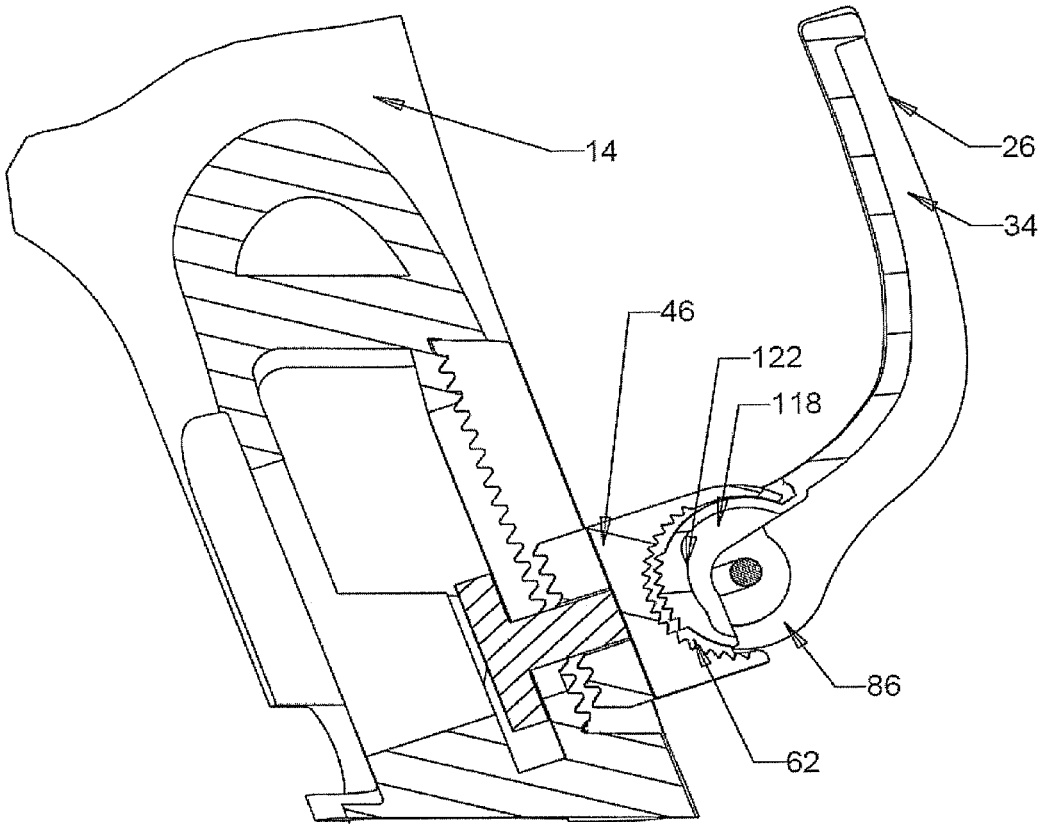
FIG. 7 illustrates a sectional side view of a version of the grip of FIG. 1 with the locking lever removed.

FIG. 7 illustrates a sectional side view of the grip 14 assembled with the hand rest 26 and with the locking lever 38 removed. The base portions 86 of the support arm 34 are positioned in the cutouts 62 of the locking block 46. The base portions 86 include the cutouts 118, which are defined by a wall 122. The cutouts 118 are configured to receive the cam arms 110 (FIGS. 4-6) of the locking lever 38 such that the cam arms 110 can engage the wall 122.

Figure 8:
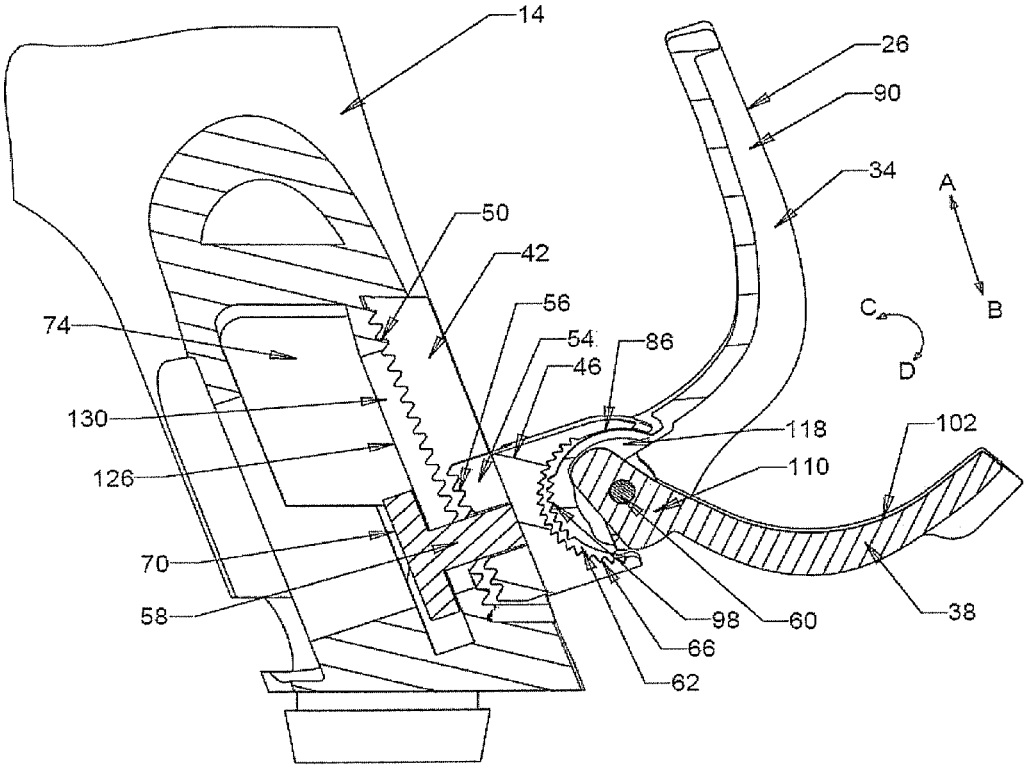
FIG. 8 illustrates a sectional side view of the grip assembled with the hand rest and in an unlocked position.

FIG. 8 illustrates a sectional side view of the grip 14 assembled with the hand rest 26. FIG. 8 shows the hand rest 26 in an unlocked position wherein the teeth 50 in the channel 42 of the grip 14 are not engaged with the teeth 56 along the center portion 54 of the locking block 46. When the hand rest 26 is in the unlocked position, the hand rest 26 is free to be moved up and down along the channel 42 of the grip 14. The head 70 of the locking shaft 58 is positioned in the cavity 74 and engages the inner side 126 of a wall 130 along the channel 42 of the grip 14. The teeth 50 in the channel 42 are located on the wall 130 opposite the inner side 126 of the wall 130. The locking block 46 is positioned along the locking shaft 58 such that the teeth 56 of the locking block 46 are not interlocking with the teeth 50 of the channel 42.

The base portions 86 of the support arm 34 are positioned in the cutouts 62 of the locking block 46 but are positioned laterally away from the teeth 66 of the cutouts 62 such that the teeth 98 of the base portions 86 are not engaged with the teeth 66 of the cutouts 62. The cam arms 110 of the locking lever 38 are positioned in the cutouts 118 of the base portions 86 of the support arm 34. The body 102 of the locking lever 38 is rotated downward away from the support arm 34. The locking shaft 58, locking block 46, support arm 34, and locking lever 38 are all connected to each other by the pin 60.

When the hand rest 26 is in the unlocked position, an operator using the grip 14 can have one hand positioned around the grip 14 and on the hand rest 26 and locking block 46 and adjust both the height and the angle of the hand rest 26 with respect to the grip body 14 with his free hand. A user can use his free hand to move the hand rest 26 up and down in the directions of Arrows A and B because the teeth 50 of the channel 42 are not engaged with the teeth 56 of the locking block 46. As the locking block 46 moves up and down, the head 70 of the locking shaft 58 slides along the inner side 126 of the wall 130 of the grip body 14.

A user can also use his free hand to rotate the support arm 34 of the hand rest 26 about the pin 60 in the directions of Arrows C and D because the teeth 98 of the support arm 34 are not engaged with the teeth 66 along the cutouts 62 of the locking block 46. By being able to adjust the height of the hand rest 26, the operator can place the hand rest 26 in a position where the operator's thumb or fingers and can operate the buttons 22 (FIG. 1) on the grip 14 while the bottom of the operator's hand rests on the hand rest 26. By being able to adjust the angle of the hand rest 26 with respect to the grip body 14, the operator can adjust the space between the plate 90 of the support arm 34 and the grip body 14 to better accommodate the size of the operator's hand.

Once the operator has moved the hand rest 26 to a desirable height and angle with respect to the grip body 14, the operator can use his free hand to rotate the locking lever 38 about the pin 60 in the direction of arrow C toward the support arm 34 to secure the hand rest 26 in a locked position.

Figure 9:
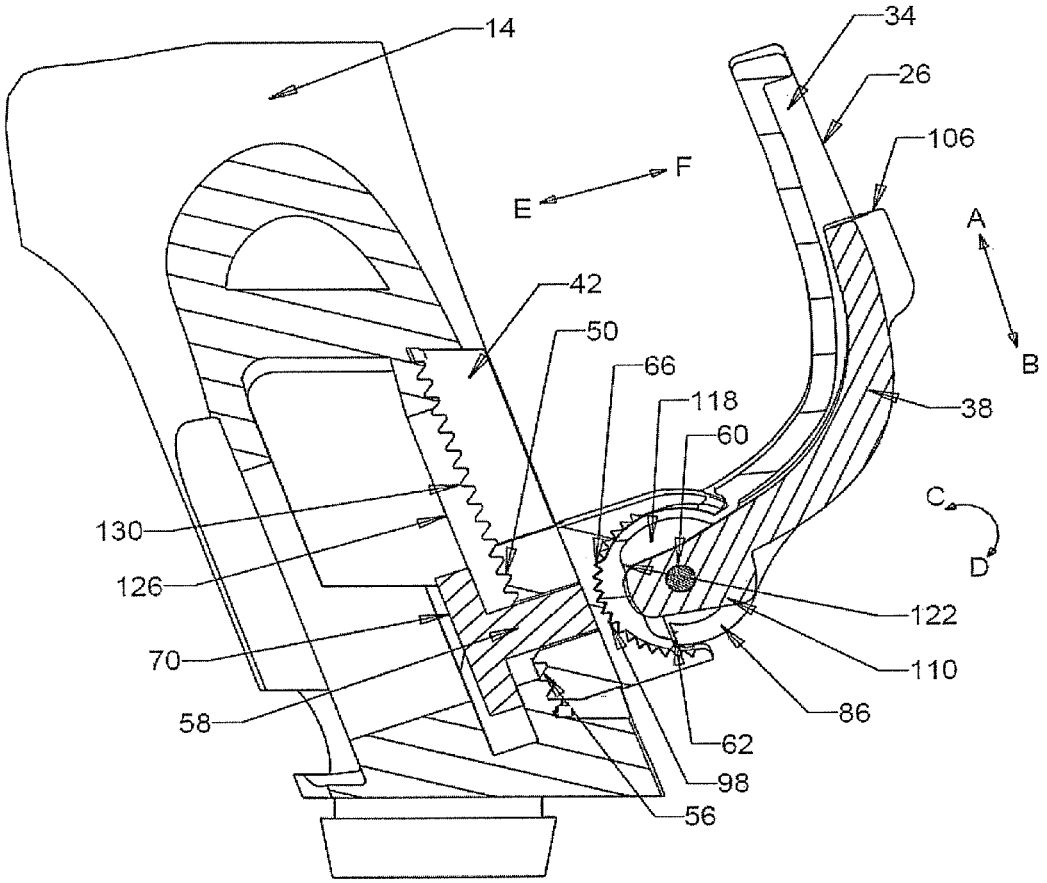
FIG. 9 illustrates a sectional side view of the grip assembled with the hand rest and with the hand rest in a locked position.

FIG. 9 illustrates a sectional side view of the grip 14 assembled with the hand rest 26 and with the hand rest 26 in the locked position. As the locking lever 38 is rotated upward in the direction of Arrow C, the cam arms 110 of the locking lever 38 engage the walls 122 of the cutouts 118 of the support arm 34. The engagement between the cam arms 110 and the walls 122 moves the base portions 86 of the support arm 34 laterally in the direction of Arrow E toward the teeth 66 of the cutouts 62 of the locking block 46.

Figure 11A:
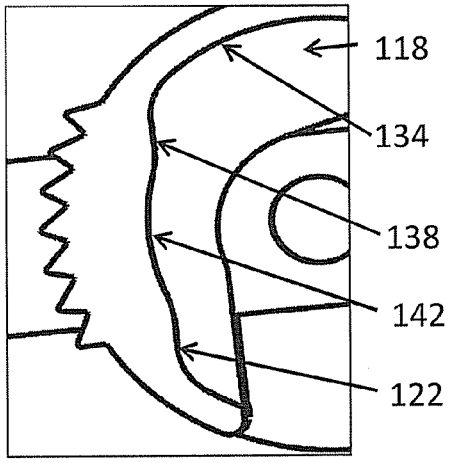
FIG. 11*a* illustrates a side view of the support arm cutout with the cam arm removed.
Figure 11B:
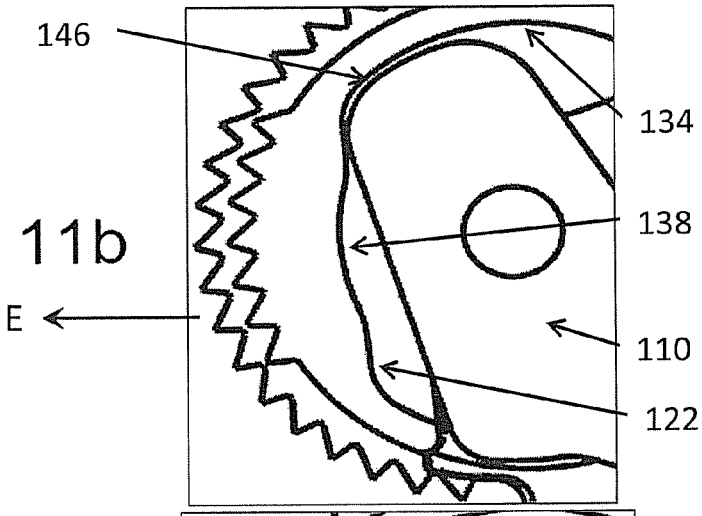
FIG. 11*b* illustrates a side view of the support arm cutout with the cam arm in a first position.
Figure 11C:
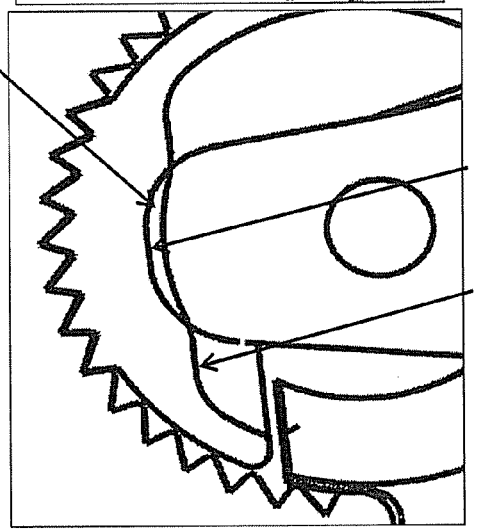
FIG. 11*c* illustrates a side view of the support arm cutout with cam arm in a second position.

The interaction of the cam arms 110 and the cutouts 118 of the support arms 34 are shown in more detail in FIGS. 11*a*-11*c*. In particular, as shown in FIG. 11*a*, the wall 122 of the cutout 118 includes a curved wall portion 134 and a contoured wall portion 138 having an indent 142. As shown in FIG. 11*b*, the cam arm 110 includes a slightly rounded end portion 146. The rounded end portion 146 of the cam arm 110 moves along the curved wall portion 134 of the cutout wall 122 as the cam arm 110 rotates without engaging the curved wall portion 134. However, when the rounded end portion 146 of the cam arm 110 engages the contoured wall portion 138, the rounded end portion 146 pushes the contoured wall portion 138, and thus the support arm 34 (FIG. 9), in the direction of Arrow E. The rounded end portion 146 rotates along the contoured wall portion 138, and pushes the contoured wall portion 138 in the direction of Arrow E, until the rounded end portion 146 is positioned in the indent 142 as shown in FIG. 11*c*.

The support arm 34 is able to move laterally in the direction of Arrow E toward the teeth 66 of the cutouts 62 because the holes 96 (FIG. 5) of the base portions 86 of the support arm 34 are large enough with respect to the pin 60 so as to allow the base portions 86 to move laterally and rotationally with respect to the pin 60. As the teeth 98 of the base portions 86 move laterally in the direction of Arrow E, the teeth 98 engage and become interlocked with the teeth 66 of the locking block 46 such that the support arm 34 is no longer free to rotate about the pin 60.

In addition, once the teeth 98 and 66 become interlocked, the force of the rotating cam arms 110 against the walls 122 of the base portions 90 is transferred from the base portions 90 to the locking block 46 in the direction of Arrow E to cause the locking block 46 to slide along the locking shaft 58 in the direction of Arrow E toward the teeth 50 in the channel 42 of the grip body 14. The locking block 46 is able to move laterally toward the teeth 50 because the hole 82 (FIG. 5) in the locking block 46 is large enough with respect to the pin 60 so as to allow the locking block 46 to move both laterally and rotationally with respect to the pin 60. As the teeth 56 of the locking block 46 move laterally in the direction of Arrow E, the teeth 56 engage and become interlocked with the teeth 50 in the channel 42 of the grip body 14 such that the locking block 46 is no longer free to move up and down in the directions of Arrows A and B with respect to the grip body 14. Therefore, when the locking lever 38 is moved to the locked position, the hand rest 26 is held in a locked position with respect to the grip 14 with the head 70 of the locking shaft 58 pressed tightly against the inner side 126 of the channel wall 130 and the teeth 56 of the locking block 46 pressed into a tight interlocked relationship with the teeth 50 of the channel 42.

To move the hand rest 26 out of the locked position, the user can insert his thumb from his free hand into the indented portion 106 of the locking lever 38 to pull the locking lever 38 in the direction of Arrow D. As the locking lever 38 rotates in the direction of Arrow D, the cam arms 110 of the locking lever 38 disengage from the walls 122 of the cutouts 118 in the support arm 34. The base portions 86 of the support arm 34 can then be moved laterally in the direction of Arrow F away from the grip body 14 such that the teeth 98 of the support arm 34 become disengaged from the teeth 66 of the locking block 46. When the teeth 98 are disengaged from the teeth 66, the support arm 34 is again free to be rotated about the pin 60 to a desirable position. In addition, as the base portions 86 of the support arm 34 moves in the direction of Arrow F away from the locking block 46, the locking block 46 becomes free to move in the direction of Arrow F as well. Movement by the locking block 46 in the direction of Arrow F disengages the teeth 56 of the locking block 46 from the teeth 50 in the channel 42 of the grip body 14. When the teeth 56 of the locking block 46 are completely disengaged from the teeth 50 in the channel 42, the locking block 46 is again free to be moved up and down along the channel 42 in the directions of Arrows A and B to a desirable position.

Figure 10:
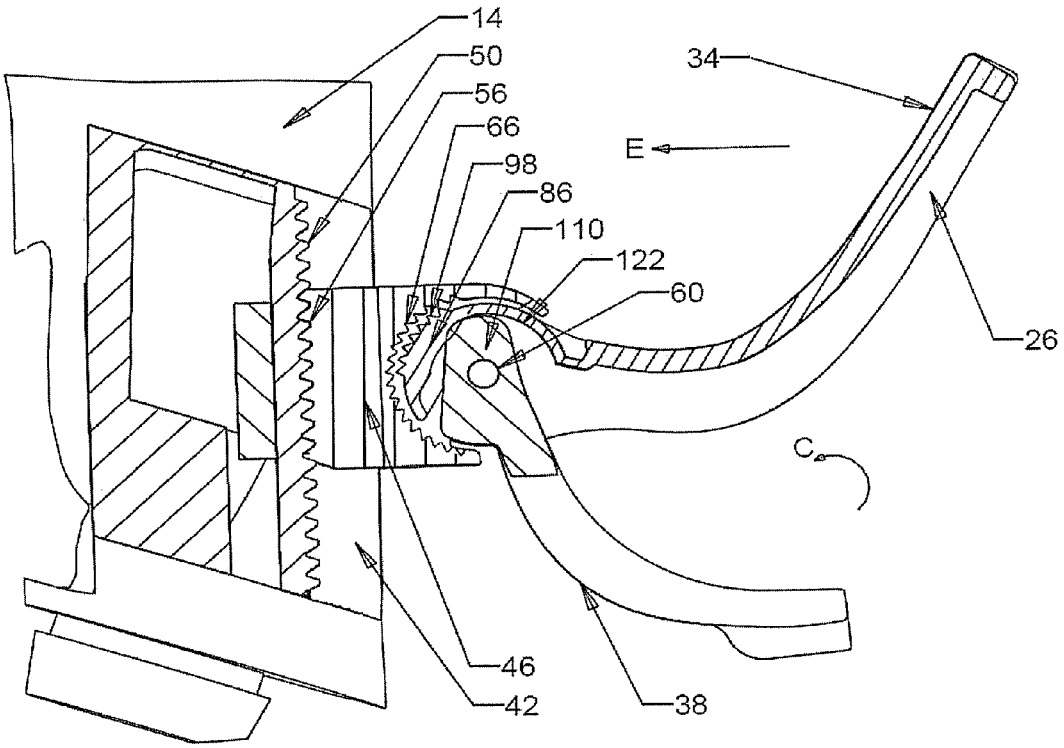
FIG. 10 illustrates a sectional side view of the grip assembled with the hand rest.

As shown in FIG. 10, a user can also unlock the hand rest 26 so that the user can adjust the angle of the support arm 34 with respect to the grip body 14 without adjusting the height of the hand support 34. The cam arms 110 of the locking lever 38 have been rotated from the locked position such that the cam arms 110 are not pushing the walls 122 of support arm 34 in the direction of Arrow E, and, therefore, the teeth 98 of the base portions 86 are not engaged with the teeth 66 of the locking block 46. With the hand rest 26 in this position, the user can use his free hand to rotate the support arm 34 about the pin 60 to a desirable position. The teeth 56 of the locking block 46, however, are still in locking engagement with the teeth 50 in the channel 42 of the grip body 14. Therefore, the hand rest 26 will not move up and down with respect to the grip body 14 while the user adjusts the angle of the support arm 34 with respect to the grip body 14.

Once the user has rotated the support arm 34 to a desirable position, the user can rotate the locking lever 38 in the direction of Arrow C to the locking position. As the locking lever 38 rotates, the cam arms 110 of the locking lever 38 engage the walls 122 of the base portions 86 of the support arm 34 and laterally move the support arm 34 in the direction of Arrow E until the teeth 98 of the support arm 34 are in locked engagement with the teeth 66 of the locking block 46.

Embodiments of the present invention provide a hand rest for use with a control grip that allows a user to keep one hand on the grip while using his free hand to move the hand rest to a desirable position. In particular, the user can use his free hand to adjust both the height of the hand rest with respect to the grip body and the angle of the hand rest with respect to the grip body. The embodiments of the present invention allow for the grip hand rest to be adjusted in two different ways with just a single free hand in order to accommodate a number of different hand shapes and sizes. Accordingly, the embodiments allow a number of users to use the same grip and hand rest without having to involve another person and/or tools to adjust the position of the hand rest every time a different person begins using the grip. The ability of the hand rest to be adjusted to accommodate, and provide support for, a variety of hand sizes and shapes helps improve operator efficiency and productivity and also provides the ergonomic benefit of helping improve conditions that may contribute to operator injuries over the course of prolonged grip use. The adjustable hand rest also allows the operator to operate the grip/joystick without having to grasp the grip/joystick with his fingers because the operator can use the back and palm of his hand to engage the hand rest to move the grip/joystick.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A hand grip, comprising:

a grip body;

a hand rest connected to said grip body, said hand rest being configured to slide and rotate with respect to said grip body, said hand rest including:

a first locking part that is configured to engage said grip body to lock said hand rest in a locked position with respect to said grip body such that said hand rest does not slide with respect to said grip body and configured to disengage from said grip body such that said hand rest can slidably move with respect to said grip body; and a second locking part that, when unlocked, allows said hand rest to rotate with respect to said grip body, and that, when locked, prevents said hand rest from rotating with respect to said grip body wherein said grip body has a first set of teeth and said first locking part of said hand rest includes a second set of teeth, wherein said second set of teeth engage said first set of teeth to lock said hand rest in said locked position;

wherein said hand rest includes a rotating support arm and a base portion, said second locking part of said hand rest including a first set of teeth on said support arm and a second set of teeth on said base portion, said first and second sets of teeth engaging each other to prevent said support arm from rotating with respect to said base portion; and wherein said hand rest further includes a cam arm that rotates with respect to said support arm and said base portion, said cam arm rotating to engage said support arm such that said support arm moves laterally toward said base portion and said first set of teeth on said support arm engages said second set of teeth on said base portion.

2. The hand grip of claim 1, wherein said grip body includes a channel and a slot therein and said base portion of said hand rest configured to slide within said channel, said base portion being connected to said grip body by a shaft that extends through said slot in said channel, said base portion sliding along said shaft such that said first locking part engages said teeth of said grip body to lock said hand rest in said lock position.

3. The hand grip of claim 1, wherein said cam arm is rotated to cause said first locking part to engage said grip body to lock said hand rest in said locked position.

4. The hand grip of claim 1, wherein said cam arm is rotated to cause said second locking part to become locked to prevent said hand rest from rotating with respect to said grip body.

5. A grip for use in controlling machinery, comprising:

a hand grip having a grip body;

a hand rest connected to said grip body, said hand rest being configured to slide with respect to said grip body and rotate with respect to said grip body, said hand rest including:

a base portion connected to said grip body by a shaft;

a support arm rotatably connected to said base portion;

a cam arm rotatably connected to said support arm, wherein said cam arm is rotatable to (1) a first position in which said cam arm engages said support arm to lock said support arm in a first locked position with respect to said base portion and lock said base portion in a second locked position with respect to said grip body and (2) a second position in which said cam arm disengages from said support arm such that said support arm can rotate with respect to said base portion and said base portion can move along said shaft with respect to said grip body; and wherein said base portion includes a first set of teeth and said support arm includes a second set of teeth and as said cam arm rotates toward said first position, said support arm moves laterally toward said base portion such that said first set of teeth and said second set of teeth engage each other.

6. The grip of claim 5, wherein said grip body includes a slot connected to a cavity and said shaft includes a first portion secured in said cavity and a second portion that extends through said slot to said base portion.

7. The grip of claim 6, wherein said grip body includes a first set of teeth positioned along said slot and said base portion includes a second set of teeth such that, when said cam arm is in said first position, said first set of teeth of said grip body are in locking engagement with said second set of teeth of said base portion.

8. The grip of claim 5, wherein when said cam arm is in said first position, said first set of teeth and said second set of teeth are in locking engagement with each other such that said support arm does not rotate with respect to said base portion.

9. A grip for use in controlling machinery, comprising:

a hand grip having a grip body;

a hand rest connected to said grip body, said hand rest being configured to slide with respect to said grip body and rotate with respect to said grip body, said hand rest including:

a base portion connected to said grip body by a shaft;

a support arm rotatably connected to said base portion; and a cam arm rotatably connected to said support arm, wherein said cam arm is rotatable to (1) a first position in which said cam arm engages said support arm to lock said support arm in a first locked position with respect to said base portion and lock said base portion in a second locked position with respect to said grip body and (2) a second position in which said cam arm disengages from said support arm such that said support arm can rotate with respect to said base portion and said base portion can move along said shaft with respect to said grip body; wherein said base portion includes a first set of teeth and said grip body includes a second set of teeth and as said cam arm rotates toward said first position, said base portion moves laterally toward said grip body such that said first set of teeth and said second set of teeth engage each other.

10. A grip for use in controlling machinery, comprising:

a hand grip having a grip body;

a hand rest connected to said grip body, said hand rest being configured to slide with respect to said grip body and rotate with respect to said grip body, said hand rest including:

a base portion connected to said grip body by a shaft;

a support arm rotatably connected to said base portion; and a cam arm rotatably connected to said support arm, wherein said cam arm is rotatable to (1) a first position in which said cam arm engages said support arm to lock said support arm in a first locked position with respect to said base portion and lock said base portion in a second locked position with respect to said grip body and (2) a second position in which said cam arm disengages from said support arm such that said support arm can rotate with respect to said base portion and said base portion can move along said shaft with respect to said grip body; wherein said cam arm includes a rounded portion and said support arm includes an indented wall portion, wherein as said rounded portion of said cam arm engages said indented wall portion, said support arm is moved to said locked position.

11. A grip for use in controlling machinery, comprising:

a hand grip having a grip body that includes a slot extending along a side thereof and a first set of teeth positioned proximate said slot;

a hand rest connected to said grip body, said hand rest including a shaft, a base portion slidably connected to said shaft, a support arm rotatably connected to said base portion, and a cam arm rotatably connected to said support arm, wherein said shaft extends from said base portion through said slot of said grip body and connects said base portion to said grip body, said base portion being slidably moveable along said shaft with respect to said grip body and said shaft being slidably moveable within said slot, said base portion further includes a second set of teeth and a third set of teeth and said support arm includes a fourth set of teeth; and wherein when said cam arm is rotated toward a locking position, said cam arm pushes said support arm laterally such that (1) said fourth set of teeth of said support arm engages said third said of teeth of said base portion to prevent rotation by said support arm with respect to said base portion and (2) said support arm pushes said base portion laterally along said shaft such that said second set of teeth of said base portion engages said first set of teeth of said grip body to prevent movement of said shaft along said slot of said grip body.

12. The grip of claim 11, wherein when said cam arm is rotated away from said locking position, said cam arm moves away from said support arm such that said support arm can move laterally away from said base portion and said fourth set of teeth and third set of teeth become disengaged from each other.

13. The grip of claim 12, wherein as said support arm moves laterally away from said base portion, said base portion moves laterally away from said grip body and said first set of teeth and second set of teeth become disengaged from each other.

14. The grip of claim 11, wherein said shaft, said base portion, said support arm, and said cam arm are connected to each other by a pin.

15. The grip of claim 14, wherein said base portion base portion receives said pin in a hole and said hole is large enough with respect to said pin such that said base portion can move laterally with respect to said pin.

16. The grip of claim 14, wherein said support arm receives said pin in a hole and said hole is large enough with respect to said pin that said support arm can rotate with respect to said pin and move laterally with respect to said pin.

* * * * *